United States Patent [19]

Orson, Sr.

[11] 4,277,864

[45] Jul. 14, 1981

[54] SPRING OPERATED CLIP

[75] Inventor: Theodore Orson, Sr., Granby, Mass.

[73] Assignee: Dielectrics Corporation, Chicopee, Mass.

[21] Appl. No.: 96,465

[22] Filed: Nov. 21, 1979

[51] Int. Cl.[3] ..... A44B 1/18; A44C 3/00

[52] U.S. Cl. ..... 24/327; 24/252 R; 24/137 R; 40/1.5; 24/255 SL; 24/342

[58] Field of Search ..... 24/80, 84 H, 255 SL, 24/81 TH, DIG. 8, 3 R, 137 R, 11 CT, 248 R, 252 R, 252 B, 255 R, 259 R, 81 B, 81 FC; 40/1.5

[56] References Cited

U.S. PATENT DOCUMENTS

| | | | |
|---|---|---|---|
| 556,209 | 3/1896 | Quinn | 24/11 CT |
| 1,291,432 | 1/1919 | Davis | 24/80 |
| 3,054,201 | 9/1962 | Burns | 40/1.5 |
| 3,131,449 | 5/1964 | Lida | 24/84 H |
| 3,135,034 | 6/1964 | Fauteux | 24/84 H |
| 3,392,727 | 7/1968 | Hanlon | 24/255 SL |
| 3,574,248 | 4/1971 | Gaglia | 24/252 R |
| 3,698,043 | 10/1972 | Batts | 24/255 SL |
| 3,733,656 | 5/1973 | Stalder | 24/137 R |
| 3,982,307 | 9/1976 | Smith et al. | 24/137 R |
| 4,192,441 | 3/1980 | Batts | 24/137 R |

FOREIGN PATENT DOCUMENTS

| | | | |
|---|---|---|---|
| 549985 | 2/1923 | France | 24/252 R |
| 2360706 | 8/1976 | France | 24/255 SL |
| 1486831 | 9/1977 | United Kingdom | 24/137 R |

*Primary Examiner*—Victor N. Sakran

*Attorney, Agent, or Firm*—Chapin, Neal & Dempsey

[57] ABSTRACT

Integral synthetic plastic spring clip used for attaching identification badges and the like to garments. The clip comprises a pair of lever arms interconnected at their outer ends by a spring-forming web. The other ends of the arms terminate in mating jaw portions. The lever arms include interengageable detent portions adapted to form a fulcrum for pivotal movement of said lever arms for the opening and closing of the jaw portions of the clip. The interengagement of said detents also biases said web so that it acts as a spring in compression to urge the jaw portions of the clip together for clamping engagement with a material disposed between said jaws.

3 Claims, 5 Drawing Figures

Fig. 1.
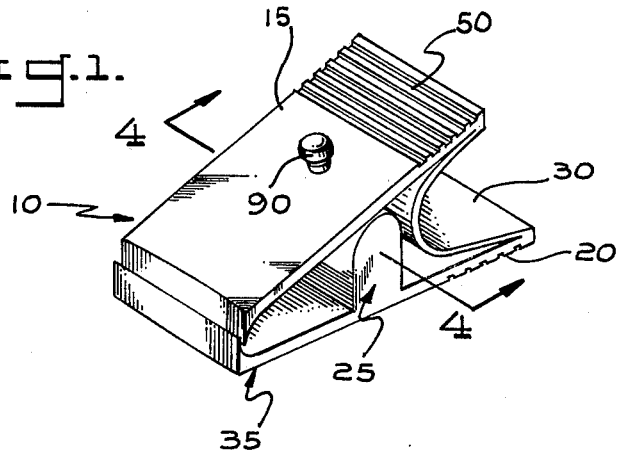
Fig. 2.
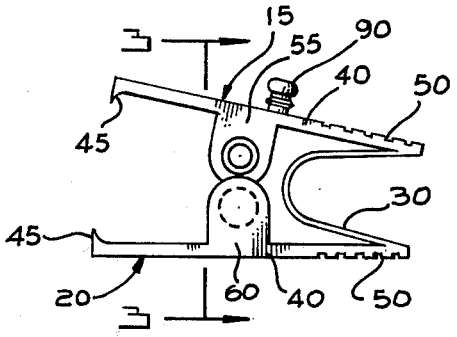
Fig. 3.
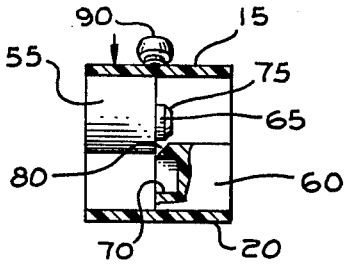
Fig. 4.
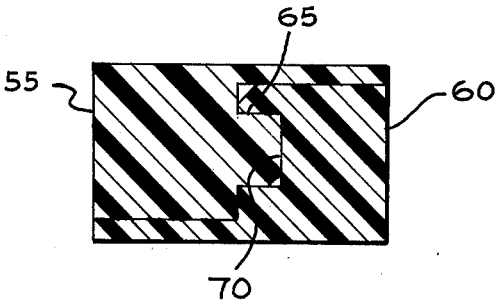
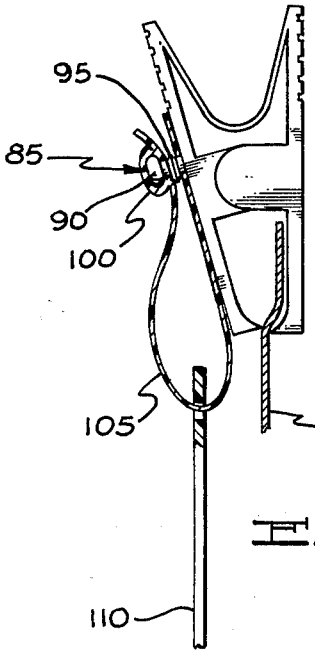
Fig. 5.

SPRING OPERATED CLIP

BACKGROUND

This invention relates to spring clips and, more particularly, to such clips as are used for supporting identification badges and the like which are often required to be worn by employees of large industrial firms.

Generally, employee identification badges involve the use of metal clips by which the badges are attached to some part of the employee's clothing, commonly the shirt pocket. Such clips have heretofore been fabricated of metal parts including jaw members pivotally connected together by a pivot pin and a separate spring element which is assembled with the jaw members and pin so as to provide a pivotable spring clip which is opened against spring tension by squeezing together the outer ends of the jaw members.

Sucn prior art spring clips are disclosed in U.S. Pat. Nos. 556,209 to Quinn and 3,054,201 to Burns. While such clips have generally been satisfactory for their intended purpose, their manufacture has proved uneconomical, particularly from the standpoint of requiring hand labor for assembly of the separate components needed for the fabrication of such clips.

While U.S. Pat. Nos. 3,698,043 to Batts and 3,982,307 to Smith disclose unitary plastic clamps, the jaws of these clamps are not urged closed by spring pressure but remain closed by the engagement of interlocking latching means. For opening these clamps, the latches must be disengaged whereupon the clamps open a predetermined amount and are closed by re-engagement of the latching means. In contrast, spring clips embodying this invention may be opened against increasing spring pressure to an infinite variety of jaw open positions and closed by simply releasing the finger pressure on the outer ends of the lever arms. The spring continuously urges the jaws toward their closed position.

Accordingly, it is the principal object of this invention to provide a unitary spring clip especially useful for the attachment of identity badges to garments.

It is another object of this invention to provide a spring clip of the above type which is uniquely adapted for injection molding in integral form.

It is a further object of this invention to provide a unitary mold spring clip which includes both a pivot member and spring portion as an integral part of the clip.

SUMMARY OF THE INVENTION

These and other objects of this invention will be more readily apparent from the following description considered together with the accompanying drawings wherein a spring clip is shown for attaching identity badges to garments and the like. The clip is of integral construction adapted for molding in unitary form wherein the jaw portions are joined by a spring-forming web in relaxed or unstressed condition. With a clip of this construction, no assembly steps are required other than a simple snap fitting of the fulcrum detent means whereby energization of the spring web is achieved. Each of the jaw portions is part of one of the pivotable lever arms which include detent means which upon interengagement provide a fulcrum for the pivotable movement of the lever arms and simultaneously cause the spring web to be placed in compression whereby the spring thereupon continuously urges the jaw portions of the clip toward their clamping relation. The clip may be opened by squeezing together the outer end portions of the lever arms thereby further compressing the spring member to open the jaws to any desired extent.

DESCRIPTION OF THE DRAWINGS

FIG. 1 is a perspective view of a clip of the type embodying the present invention;

FIG. 2 is a elevational side view of the clip;

FIG. 3 is a sectional view taken along line 3—3 of FIG. 2;

FIG. 4 is a sectional view, on an enlarged scale, taken along line 4—4 of FIG. 1; and FIG. 5 is an elevational side view of the clip showing the same being used for supporting an identity badge on a garment part.

DESCRIPTION OF THE PREFERRED EMBODIMENT

Referring to the drawings, a clip of the type embodying the invention is shown generally at 10, comprising a pair of lever arms 15 and 20 pivotable about a fulcrum 25 generally disposed midway between the inner and outer ends of the arms 15 and 20 and the mating jaw portions of the clip shown generally at 35. The clip also includes a spring portion 30 which comprises a U-shaped web interconnected at its outer ends to the outer ends of lever arms 15 and 20. The U-shaped web serves to unite the two lever arms of the clip and acts as a leaf spring which in compression urges the jaw portions of the clip toward their closed position as shown in FIG. 1.

The clip embodying this invention is adapted to be economically manufactured by injection molding technique. Upon removal from the mold, no labor is required to complete the fabrication or assembly of the product. Preferably, the clip is molded from a synthetic plastic material which is sufficiently strong and resilient to impart the desired characteristics to the clip. One material found suitable for this purpose is a cured acetal resin. The configuration of the mold cavity is such that the lever arms 15 and 20 diverge outwardly from the ends of the lever arms to which the spring web 30 is attached (FIG. 2). In this condition, the detent portions of fulcrum 25 are disengaged, and the web 30 is in a relaxed or unstressed condition. When the portions which form the web are interconnected, as shown in FIG. 1, the spring is energized to urge the jaws 35 into mutual clamping engagement.

The lever arms 15 and 20 are generally in the form of rigid planar members of rectangular configuration. The outer ends of the lever arms are preferably ribbed or knurled, as shown at 50 in FIG. 1, to assist the user in gripping the clip for squeezing together the outer ends of the lever arms against the pressure of spring web 30.

Fulcrum 25 comprises a pair of bosses or lugs 55 and 60 which extend outwardly from the inner surfaces of the lever arms 15 and 20 respectively. The bosses are located about midway of the length of the arms 15 and 20 so that when the outer ends of the arms are squeezed together, the jaws of the clip end swing open about the same distance the outer ends of the arms are squeezed together. Boss 55 is disposed adjacent the outer edge of the arm 15, and boss 60 is located adjacent the opposite edge of the arm 20. The bosses each occupy about ½ of the width of the respective arm of which they are a part whereby their inner surfaces lie approximately in the same vertical plane, as best seen in FIG. 3.

The opposed inner surfaces of these bosses are provided with interlocking detent means for providing a pivot or fulcrum for the pivotable movement of the arms and also, when engaged, for placing the spring web 30 in compression. In the embodiment shown, a post member 65 extends outwardly of the boss 55 and a mating socket 70 is formed within the boss 60. Preferably, the outer edge portion of the post 65 is chamferred and the upper edge portion of the boss 60 is tapered, as shown at 80, to provide a "lead-in" or cam surface which facilitates the snap fitting together of the post and socket. Detent engagement is accomplished simply by squeezing together the lever arms 15 and 20 at about the center of the clip.

As best seen in FIGS. 2 and 3, the clip of the present invention is injection molded in a single cavity molded with the parting line thereof located in the Plane A—A illustrated in FIG. 3. The cavity of the mold is such that the arms of the clip when first removed from the mold are oriented in divergent relation from their outer ends, as shown in FIG. 2, and the post and socket detent 65 and 70 are disposed in vertically spaced relation, as shown in FIG. 3. Moreover, the web 30 is in unstressed condition and the jaws of the clip are widely spaced apart. In order to convert the molded clip from its nascent condition, it is merely necessary to squeeze together the lever arms at about their midpoints so that the post 65 will snap fit automatically in socket 70. As this is being done, it will be noted by reference to FIG. 3 that the arms 15 and 20 will be deflected laterally in opposite directions so that the end of the post 65 will ride up and over the cam surface 80. This detent action is opposed by torsional stresses in the spring web 30, but once engaged, the spring web 30 will maintain the post and socket in their engaged relation, and they cannot be disengaged unless the arms 15 and 20 are deliberately flexed laterally apart against the retaining force of the spring 30.

When the post and socket member of the clip are engaged, the spring web 30 is energized or placed in compression whereby it continuously urges the jaw portions 35 of the clip into their clamping relation, as shown in FIG. 1. The spring 30 is in the nature of a leaf spring of generally U-shaped configuration. Its outer edges are joined at the outer ends of the arms 15 and 20.

Referring to FIG. 5, when the spring clip is desired to be employed for fastening identity badges to clothing, the outer surface of one of the lever arms is provided with a post or stud 85 having an enlarged outer or head portion. The stud is formed integrally with the remainder of the unitary clip and in the preferred embodiment, will serve as the post of a snap fastener engageable with a mating socket formed in the end of a strap 105 for removeably securing the strap to the clip. The other end of the strap 105 is apertured so that the strap may be placed in loop form depending from the post 85 thereby providing a hanger strap for supporting an identity badge, as indicated at 110.

Having thus described my invention, what is claimed is:

1. Spring clip integrally molded of synthetic plastic material comprising a pair of lever arms adapted for pivotable movement about a fulcrum provided by interengageable post and socket detents formed on opposed inner surface portions of a pair of bosses, each boss extending from opposite side edges of each arm, the axis of engagement of said post and socket detents extending transversely of the direction of pivotable movement of said lever arms, the inner end portions of said lever arms being in the form of jaws which by manipulation of the outer ends of said lever arms are movable toward and away from each other for selectively clamping and releasing a material disposed therebetween, a resilient spring forming web of synthetic plastic material disposed between the outer end portions of said lever arms, the spring web being generally U-shaped and of substantially lesser thickness than said arm portions of the clip and with the outer end portions of the spring web extending from the outer ends of said lever arms and having a curved central portion disposed toward said detents, said spring web being in unstressed condition when the detents are not engaged and being energized to bias said jaws toward their mutual clamping relation when said post and socket detents are engaged, whereby said jaws are urged closed by said spring web and are opened by compressing said spring by squeezing together the outer end portions of said lever arms, said clip being molded with said bosses spaced apart with their inner surfaces generally co-planar and said spring web in its relaxed condition, said mating post and socket detents adapted to snap-fit into engagement when said lever arms are squeezed together after removal of the clip from the mold, said post and socket detents serving as the pivot fulcrum of the lever arms of said clip.

2. Spring clip, as set forth in claim 1, in which said post and socket include camming means by which squeezing together automatically of said lever arms will cause the post and socket to snap fit together thereby placing the spring web in compression.

3. Spring clip, as set forth in claim 1, in which a stud for supporting a badge extends outwardly of the outer surface of one of said lever arms and include an enlarged head portion adapted to interfit with a mating female portion of a post and socket snap fastener combination for supporting an identity badge or the like.

* * * * *